United States Patent [19]

Liebing

[11] Patent Number: 5,036,563

[45] Date of Patent: Aug. 6, 1991

[54] ROTATIONAL ELEVATOR ROPE CLEANING DEVICE

[75] Inventor: Michael V. Liebing, Palmer, Ak.

[73] Assignee: Otis Elevator Company, Farmington, Conn.

[21] Appl. No.: 580,237

[22] Filed: Sep. 10, 1990

[51] Int. Cl.[5] ..... A46B 7/10; A46B 13/00

[52] U.S. Cl. ..... 15/256.6; 15/88; 15/181; 198/496

[58] Field of Search ..... 15/256.5, 256.6, 100, 15/88.3, 88, 256.52, 179, 181, 160; 198/496

[56] References Cited

U.S. PATENT DOCUMENTS

| | | | |
|---|---|---|---|
| 575,520 | 1/1897 | Grupelli | 15/256.6 X |
| 3,229,808 | 1/1966 | Olson | 15/256.5 X |
| 3,470,576 | 10/1969 | Troia | 15/100 |

*Primary Examiner*—Edward L. Roberts

*Attorney, Agent, or Firm*—William W. Jones

[57] ABSTRACT

Elevator hoist ropes are continuously cleaned by a rotatable generally cylindrical wire brush assembly mounted in the machine room or hoistway along the path of travel of the hoist ropes. The axis of rotation of the wire brush is skewed to the direction of movement of the hoist ropes so as to cause the brush bristles to enter the rope strand valleys whereby grease and other materials are cleaned out of the inter-strand valleys on the rope.

4 Claims, 3 Drawing Sheets

ROTATIONAL ELEVATOR ROPE CLEANING DEVICE

DESCRIPTION

1. Technical Field

This invention relates to an assembly for in situ cleaning of elevator hoist ropes in the machine room during normal operation of the elevator.

2. Background Art

Elevator hoist ropes are periodically lubricated with a preservative, and are also exposed to foreign materials that may be found in the elevator hoistway. It is desirable to keep the hoist ropes, which are actually relatively heavy woven steel cables, clean so that accurate movement of the ropes, without slippage, can be achieved by the sheaves, including the traction sheave, of the elevator system. It is also essential that the ropes be clean so that they can be properly inspected. It is noted that most modern elevators operate by means of traction imparted to the ropes by the powered or traction sheave, whereby rope slippage is undesirable.

Presently, the hoist ropes may be cleaned by wooden handled wire brushes mounted in the machine room so that the hoist ropes move up and down through the brush bristles. This approach has several drawbacks relating to efficiency and durability. Since the brushes are fixed in the machine room, the ropes pass back and forth over the same area of the bristles causing the bristles to quickly wear down and become ineffective. The orientation of the bristles also results in a cleaning of only the crowns of the hoist rope braids, leaving the intervening valleys untouched. This is because the ropes move up and down through the bristles vertically, while the rope braids are always aligned skewed to the vertical direction. The fixed brushes may thus merely deposit material from the braid crowns into the intervening valleys.

DISCLOSURE OF THE INVENTION

This invention relates to a hoistway rope cleaning assembly which has an improved useful life, and which provides more complete cleaning of the ropes than the above-noted prior art cleaner. The rope cleaning assembly of this invention includes an array of disk-shaped wire brushes which combine to form a cylindrical wire brush. The brush is mounted on a shaft which is disposed on a bracket fixed in the machine room adjacent to the path of travel of the ropes. The brush is free to rotate with the shaft so as to change the points of contact between the ropes and brush bristles. The shaft is mounted skewed to an imaginary line which cuts across the ropes perpendicular to the path of travel of the ropes. The skew angle is set so as to cause the brush bristles to move through the rope braid valleys as well as over the rope braid crowns, thus affording an improved cleaning of the ropes.

It is therefore an object of this invention to provide an improved elevator hoist rope cleaning assembly which has an extended operational life.

It is a further object of this invention to provide a hoist rope cleaning assembly of the character described which removes a greater percentage of grime from the hoist ropes.

It is another object of this invention to provide a hoist rope cleaning assembly of the character described which can be securely mounted at a number of different locations in the hoistway and machine room and which can be easily serviced and maintained.

These and other objects and advantages of the invention will become more readily apparent from the following detailed description of a preferred embodiment thereof when taken in conjunction with the accompanying drawings, in which:

BEST MODE FOR CARRYING OUT THE INVENTION

Figure 1:
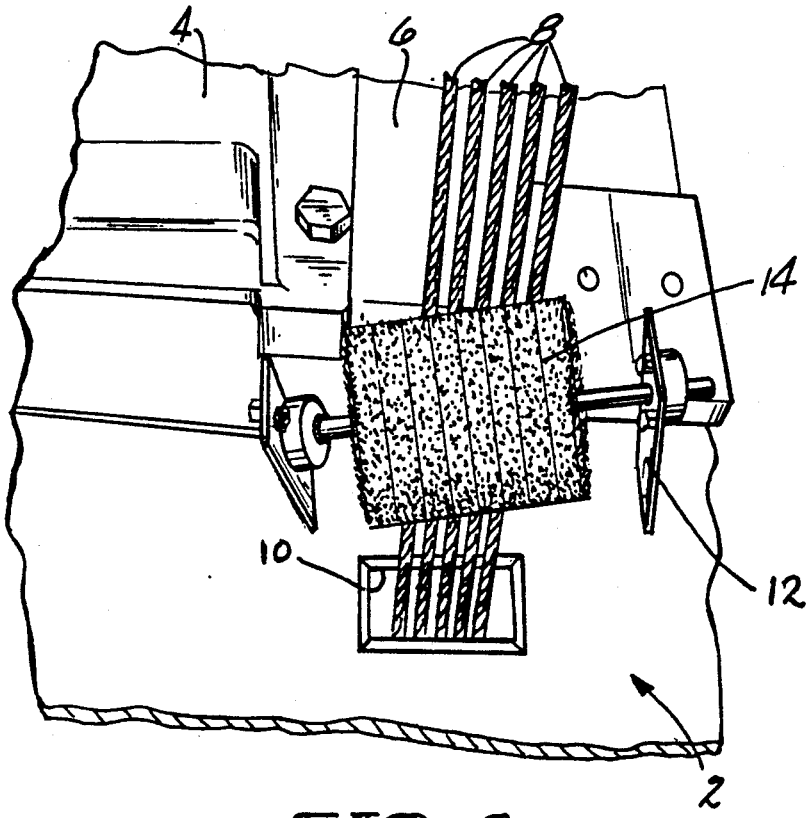
FIG. 1 is a perspective view of one embodiment of the rope cleaning assembly of this invention shown mounted in the elevator machine room.
Figure 2:
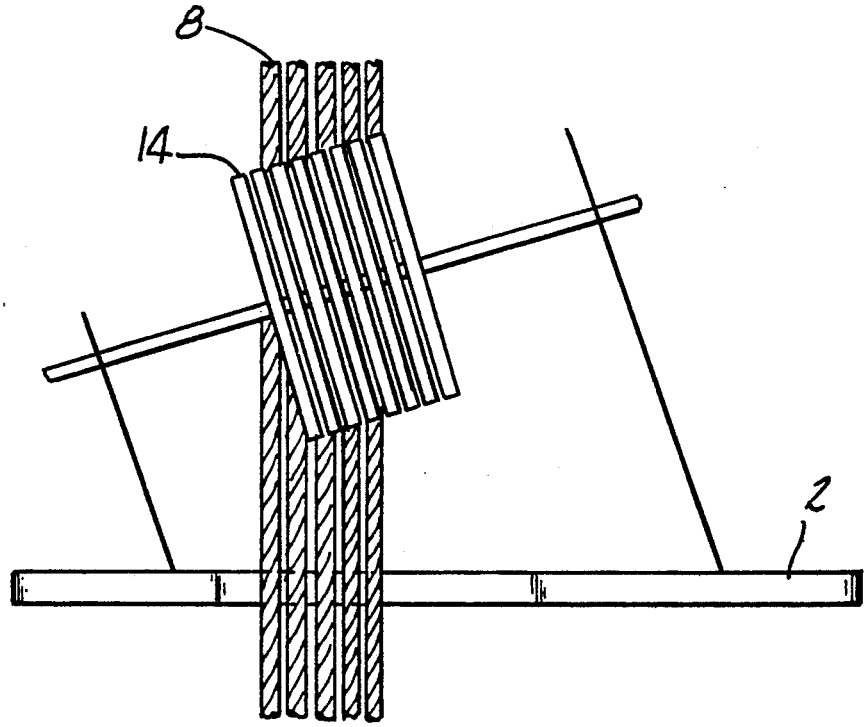
FIG. 2 is a front elevational schematic view of the assembly of FIG. 1 showing the angular relationship between the cleaning brush and the ropes.
Figure 3:
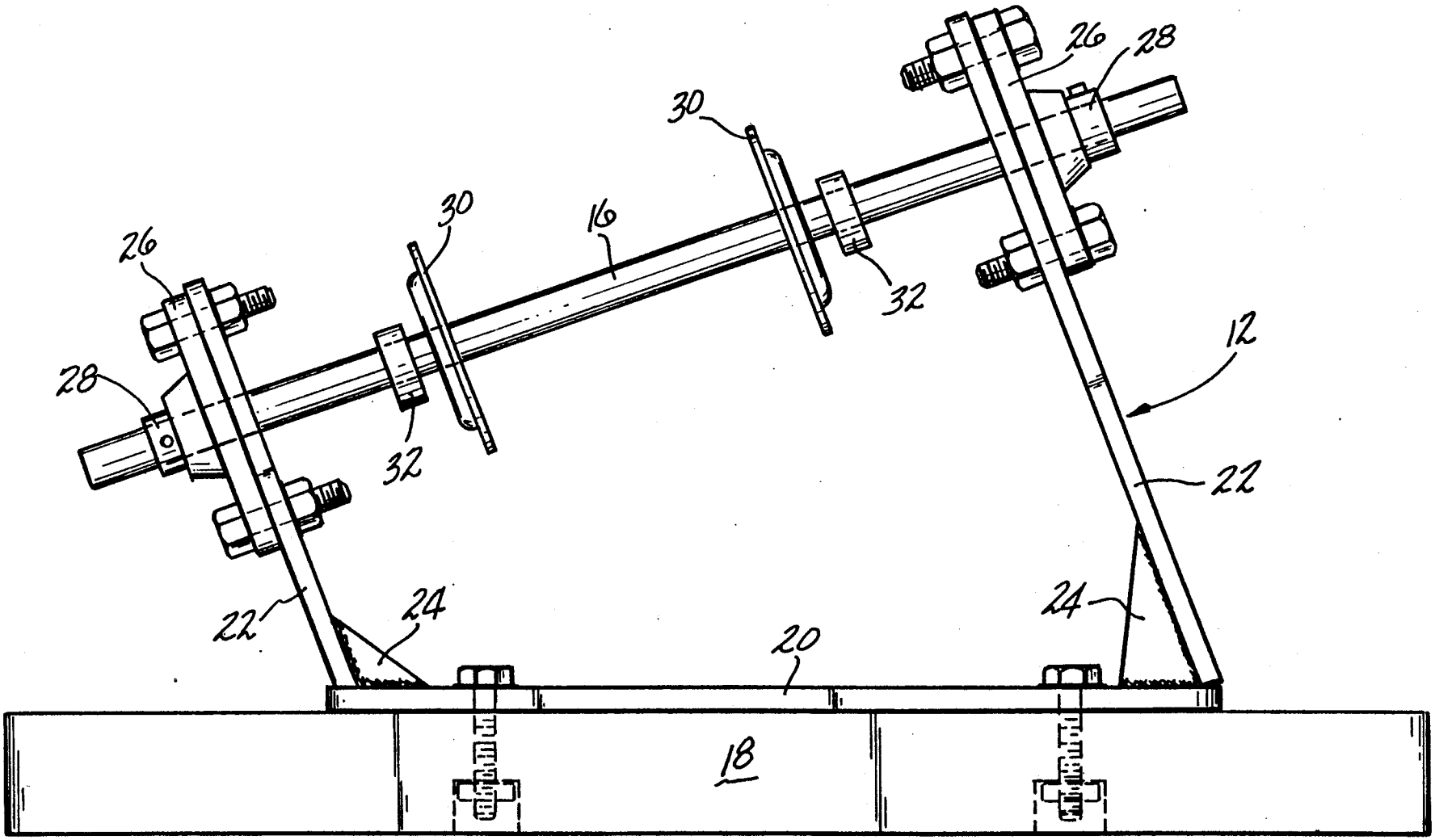
FIG. 3 is a front elevational view of the brush mount portion of the assembly of FIG. 1.
Figure 4:
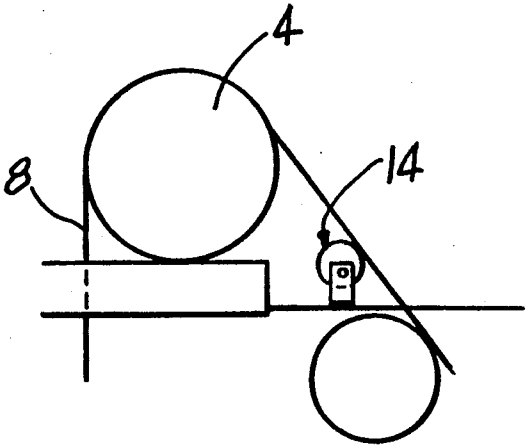
FIGS. 4–6 are schematic views showing several different locations for mounting the assembly in the elevator system.
Figure 5:
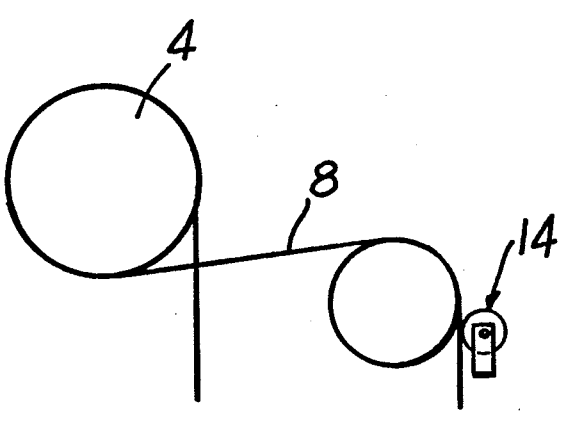
Figure 6:
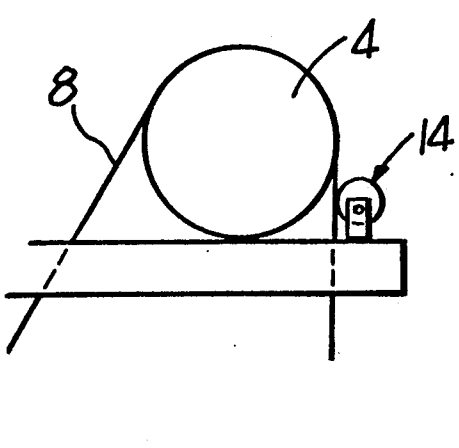

Referring to FIGS. 1 and 2, an elevator machine room denoted generally by the numeral 2 is shown. An electric motor 4 is disposed on the machine room floor 6. The motor 4 drives a traction sheave (not shown) on which the hoist ropes 8 are entrained. The hoist ropes 8 pass through an opening 10 in the machine room floor 6 and a stand 12 is mounted next to the opening 10. The stand 12 supports the wire brush assembly 14 so that, as seen in FIG. 2, the axis of the brush assembly 14 is skew to the axis of elongation of the ropes 8. This allows the brush bristles to abraid the valleys between the rope braids more efficiently. The brush assembly 14 is formed from a plurality of wire brush disks which are mounted on a shaft 16 on the stand 12. Details of the stand 12 are best shown in FIG. 3. The stand 12 may include a wood base plate 18 to which a steel plate 20 is bolted. Support arms 22 are obliquely mounted on the plate 20 and supported by corner braces 24. Flanges 26 are bolted to the arms 22 and the shaft 16 is mounted on the arms 22 and flanges 26 and axially positioned by locking collars 28. The brushes 14 are held in place on the shaft 16 by end disks 30 which are backed by lock collars 32. The brushes 14 thus can rotate with the shaft 16 and slide slightly back and forth on the shaft 16 under the influence of the ropes 8 which move up and down through the brushes 14. FIGS. 4–6 show several of the many places the brush assembly 14 can be located to clean the ropes 8.

It will be readily appreciated that the brush assembly of this invention provides a longer useful life due to the rotational mounting of the brushes on the assembly whereby the same limited bristle area is not constantly in contact with the hoist ropes. The canting or skewing of the axis of rotation of the brushes also provides for a more thorough cleaning of the hoist ropes by enabling the bristles to enter the valleys between adjacent braids of the hoist ropes to remove grime therefrom.

Since many changes and variations of the disclosed embodiment of the invention may be made without departing from the inventive concept, it is not intended to limit the invention otherwise than as required by the appended claims.

What is claimed is:

1. An assembly for cleaning elevator hoistway ropes in situ, said assembly comprising:

a) a generally cylindrical wire brush array positioned adjacent to the hoistway ropes for engagement therewith as the ropes move up and down in the hoistway; and b) means mounting said brush array for rotation about an axis whereby said brush array will rotate about said axis in response to rope movement to constantly change the portions of said brush array which contact the ropes.

2. The assembly of claim 1 wherein said brush array axis of rotation is skewed to the axis of elongation of the hoist ropes whereby brush bristles will scour rope braid valleys on the hoist ropes.

3. The assembly of claim 2 wherein said brush array is formed from a plurality of wire brush disks which are mounted on a shaft forming said axis of rotation.

4. The assembly of claim 3 wherein said brush array is mounted on said shaft in a manner which allows limited axial shifting of said brush array on said shaft in response to reversal of direction of movement of the ropes.

* * * * *